US007483836B2

(12) United States Patent
Taori et al.

(10) Patent No.: US 7,483,836 B2
(45) Date of Patent: Jan. 27, 2009

(54) PERCEPTUAL AUDIO CODING ON A PRIORITY BASIS

(75) Inventors: Rakesh Taori, Eindhoven (NL); Steven Leonardus Josephus Dimphina Elisabeth Van De Par, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 784 days.

(21) Appl. No.: 10/139,179

(22) Filed: May 6, 2002

(65) Prior Publication Data

US 2003/0061055 A1 Mar. 27, 2003

(30) Foreign Application Priority Data

May 8, 2001 (EP) ..... 01201689

(51) Int. Cl.
*G10L 19/02* (2006.01)

(52) U.S. Cl. ..... 704/500; 704/200.1

(58) Field of Classification Search ..... 704/200.1, 704/226, 229, 501, 504, 500
See application file for complete search history.

(56) References Cited

U.S. PATENT DOCUMENTS 4,972,484 A * 11/1990 Theile et al. ..... 704/200.1
5,550,924 A * 8/1996 Helf et al. ..... 381/94.3
5,632,003 A * 5/1997 Davidson et al. ..... 704/200.1
5,790,759 A * 8/1998 Chen ..... 704/200.1
5,842,160 A * 11/1998 Zinser ..... 704/229
6,058,361 A * 5/2000 Mainard ..... 704/220
6,115,689 A * 9/2000 Malvar ..... 704/503
6,138,090 A * 10/2000 Inoue ..... 704/500
6,144,937 A * 11/2000 Ali ..... 704/233
6,195,633 B1 * 2/2001 Hu ..... 704/500

(Continued)

FOREIGN PATENT DOCUMENTS

EP 0551705 * 7/1993

(Continued)

OTHER PUBLICATIONS

"A Switched Parametric & Transform Audio Coder"—Scott N. Levine and Julius O. Smith III—Center for Computer Research in Music and Acoustics Department of Electrical Engineering Stanford University.

(Continued)

*Primary Examiner*—Talivaldis I Smits

(57) ABSTRACT

The invention concerns audio coding methods and particularly relates to an efficient means by which selected frequency bands of information from an original audio signal which are audible but which are perceptually less relevant need not be encoded, but may be replaced by a noise filling parameter. Those signal bands having content which is perceptually more relevant are, in contrast fully encoded. Encoding bits may be saved in this manner, without leaving voids in the frequency spectrum of the received signal. In this way, this method avoids the annoying bandwidth switching artefacts that can occur when full bandwidth audio is encoded with a bit budget which is too low to represent the signal within each frequency band. Thus, this method allows an increase in the encoded audio bandwidth without introducing annoying bandwidth switching artefacts. The noise filling parameter is a measure of the RMS signal value within the band in question and is used at the reception end by a decoding algorithm to indicate an amount of noise to inject in the frequency band in question.

16 Claims, 4 Drawing Sheets

U.S. PATENT DOCUMENTS

| | | | | |
|---|---|---|---|---|
| 6,240,386 | B1 * | 5/2001 | Thyssen et al. | 704/220 |
| 6,256,608 | B1 * | 7/2001 | Malvar | 704/230 |
| 6,385,572 | B2 * | 5/2002 | Hu | 704/200.1 |
| 6,393,338 | B1 * | 5/2002 | Kemnitz | 700/231 |
| 6,418,404 | B1 * | 7/2002 | Yin | 704/200.1 |
| 6,522,698 | B1 * | 2/2003 | Irving et al. | 375/272 |
| 6,792,402 | B1 * | 9/2004 | Chen | 704/200.1 |
| 6,801,886 | B1 * | 10/2004 | Pai et al. | 704/200.1 |
| 6,968,564 | B1 * | 11/2005 | Srinivasan | 725/9 |
| 7,080,006 | B1 * | 7/2006 | Kupferschmidt et al. | 704/200.1 |

FOREIGN PATENT DOCUMENTS

| | | |
|---|---|---|
| WO | WO9731367 | 8/1997 |

OTHER PUBLICATIONS

"Improvements to the Switched Parametric & Transform Audio Coder"—Scott N. Levine and Julius O. Smith III, Proc. 1999 IEEE Workshop on Applications of Signal Processing to Audio and Acoustics, New Paltz, NY, Oct. 17-20, 1999.

"Multiband Excitation Vocoder" Daniel W. Griffin and Jae S. Lim, Fellow, IEEE, IEEE Transactions of Acoustics, Speech, and Signal Processing, vol. 36, No. 8, Aug. 1988, pp. 1223-1235.

* cited by examiner

PERCEPTUAL AUDIO CODING ON A PRIORITY BASIS

The invention relates to audio coding.

In the prior art, many speech and music coding techniques have been described. Among the known techniques for audio coding are transform based audio coding systems employing adaptive bit allocation. In such adaptive bit allocation systems, the bandwidth that can be encoded given the available bit budget varies according to the spectral makeup of the various segments in the audio signal for any given audio frame. By audio frame, it is meant a particular consecutive block of audio, such as for instance, a 20 ms audio block. As it is not possible to find a single value for the encoded bandwidth that is optimal for all audio frames, in terms of audio quality at a given bit rate, bandwidth switching occurs from frame to frame. Unfortunately, switching of the encoded bandwidth can often introduce annoying artefacts.

In some current schemes, at high bit rates, the full audio bandwidth (here assumed to be 22.04 kHz corresponding to a sampling rate of 44.1 kHz) is encoded and reconstructed. However, at lower bit rates if an attempt is made to encode the full bandwidth, then distortion increases. At some point, it becomes advisable to reduce the audio bandwidth by a certain amount, and to reallocate bits so as to encode that reduce bandwidth in a more accurate fashion and thereby reduce the artefacts, albeit over a limited frequency range. For instance, in MPEG-1 layer 3 coders (MP3 coders) the bandwidth is halved (to around 11 kHz) when the desired bit rate is lowered to 32 KBPS. Also, AAC has a provision to decrease bandwidth when bit rates become increasingly reduce. This is achieved by using layered coding approaches, whereby the layers representing the higher frequencies are dropped first. Reducing signal bandwidth is therefore a commonly adopted solution in wave form coders.

WO97/31367 (A T & T Corp.) discloses a speech coder using LPC (linear predictive coding) and an extra pitch extractor, to encode speech. A residue is consecutively encoded with a transform coder. It may occur that for coding of the residue so few bits are available that certain transform coefficients do not get bits at all, i.e. are set to zero. Where coding of the residue does occur, noise filling is carried out for this residue information, but the bands in question are not provided with any independently decodable information to enable schemes other than the specific LPC coding scheme used for the main part. Further, this noise filling algorithm is not carried out on a systematic basis with respect to the levels of the input signal itself, but is carried out only on the residue—leading to variable results.

It is an aim of embodiments of the present invention to reduce the problem of artefact introduction caused by the bandwidth switching problem without limiting the encoding bandwidth to a safe conservative value needed to avoid switching artefacts.

According to a first aspect of the invention, there is provided a method of coding an audio signal, the method comprising: partitioning the signal into a plurality of frequency bands; comparing amplitudes of the signal in the various frequency divided bands to respective threshold values; and coding the signal of the divided frequency bands on a priority basis such that frequency bands in which the amplitude of the signal in the particular frequency band exceeds its respective threshold value by a greatest amount are coded according to a given coding scheme, whereas for other frequency bands a noise fill parameter is selectively allocated.

The method of the first aspect has particular advantages in that noise filling of less significant bands can be done in a manner which is relatively independent of the encoding scheme used for the significant bands. In other words, the noise filling principle may be applied to most encoding methods.

The method is particularly efficient in encoding schemes operating on a fixed bit budget per time frame. In such cases, the bit budget is allocated in a priority based manner with a few bits reserved such that when too few bits remain to fully encode a full audio bandwidth signal the remaining bits are utilised to provide noise fill parameters for those unencoded and perceptually less relevant bands.

Preferably, the threshold value for a given frequency band is slightly higher than the amplitude above which noise is perceptible to the human ear for the band in question according to a psycho-acoustical model.

Some schemes may also be envisaged in which the bit budget is to be variable, but in which only those frequency bands having amplitudes which exceed the threshold by more than a predetermined amount are encoded.

Because any psycho-acoustical model is only a representation of the hearing capabilities of an average listener, high quality schemes may be envisaged in which some bands may be encoded fully even if they have a signal amplitude level below the threshold. Equally, more efficient schemes could be implemented in which a loss of quality is acceptable—in which case coding of some bands having signal amplitudes slightly above their respective threshold level may be acceptable. Therefore, whilst the aforementioned predetermined amount is preferably zero, it may be slightly positive or slightly negative.

Preferably, each frequency band for which the amplitude of the signal of the given frequency band does not exceed its respective threshold by the predetermined amount is allocated a single noise fill parameter.

Preferably, the noise fill parameter comprises a representation of the magnitude of the noise to be inserted in the respective frequency band.

Providing such magnitude representation in direct association with the frequency band enables a highly efficient noise filling operation to be carried out—it is always the case here that the magnitude representation is encoded at an easily retrievable location, i.e. at the point at which the signal information for that band would ordinarily be found.

Preferably, the magnitude representation comprises an RMS value representing the average amplitude of the received audio signal across the respective frequency band.

Preferably, for frequency bands for which a noise fill parameter is allocated, the noise fill parameter is encoded and provided in a position in the output signal where encoded signal information would otherwise be present.

Preferably, an identifier is provided associated with each band to indicate whether a noise fill parameter or encoded signal information is present.

Preferably, the identifier is a parameter ordinarily used to indicate a number of quantization levels in the encoded signal information.

If the identifier indicates a zero number of quantization levels, then this may be interpreted as meaning that a noise fill parameter, rather than encoded signal information is included for the respective band.

According to a second aspect of the invention, there is provided a method of decoding a signal, where the signal has been encoded according to the method of the first aspect, the decoding method comprising: receiving a coded audio signal; for a given frequency band of the coded signal determining whether a received signal includes encoded signal information relating to the amplitude of a transmitted signal within the given frequency band or whether it includes a noise fill parameter; if the received signal includes encoded signal information, decoding the information to produce an output audio signal portion for that frequency band; and if the received signal includes a noise fill parameter, synthesizing an output audio signal portion for that frequency band by outputting a noise signal across the frequency range of that frequency band to an amplitude indicated by the noise fill parameter.

According to a third aspect, there is provided audio coding apparatus arranged for coding an input signal and including partitioning means for partitioning the signal into a plurality of frequency bands; comparing means for comparing amplitudes of the signal in the various frequency divided bands to respective threshold values; and a coder for coding the signal of the divided frequency bands on a priority basis such that frequency bands in which the amplitude of the signal in the particular frequency band exceeds its respective threshold by a greatest amount are coded according to a given coding scheme, the apparatus being characterised in that for other frequency bands a noise fill parameter is selectively allocated.

According to a fourth aspect of the invention, there is provided audio decoding apparatus for decoding an encoded audio signal, the decoding apparatus comprising: reception means for receiving a coded audio signal; processing means arranged to, for a given frequency band of the coded signal, determine whether a received signal includes encoded signal information relating to the amplitude of a transmitted signal within the given frequency band or whether it includes a noise fill parameter; first decoding means for, if the received signal includes encoded signal information, decoding the information to produce an output audio signal portion for that frequency band; and second decoding means for, if the received signal includes a noise fill parameter, synthesizing an output audio signal portion for that frequency band by outputting a noise signal across the frequency range of that frequency band to an amplitude indicated by a noise fill parameter.

According to a fifth aspect of the invention, there is provided an encoded audio signal, wherein the signal is partitioned into a number of frequency bands, a first plurality of said frequency bands including encoded signal information being coded according to a given coding scheme and a second plurality of frequency bands including a noise fill parameter.

According to a sixth aspect of the invention, there is provided a storage medium on which an encoded audio signal according to the fifth aspect is stored.

For a better understanding of the invention, and to show how embodiments of the same may be carried into effect, reference will now be made, by way of example, to the accompanying diagrammatic drawings in which.

Figure 1:
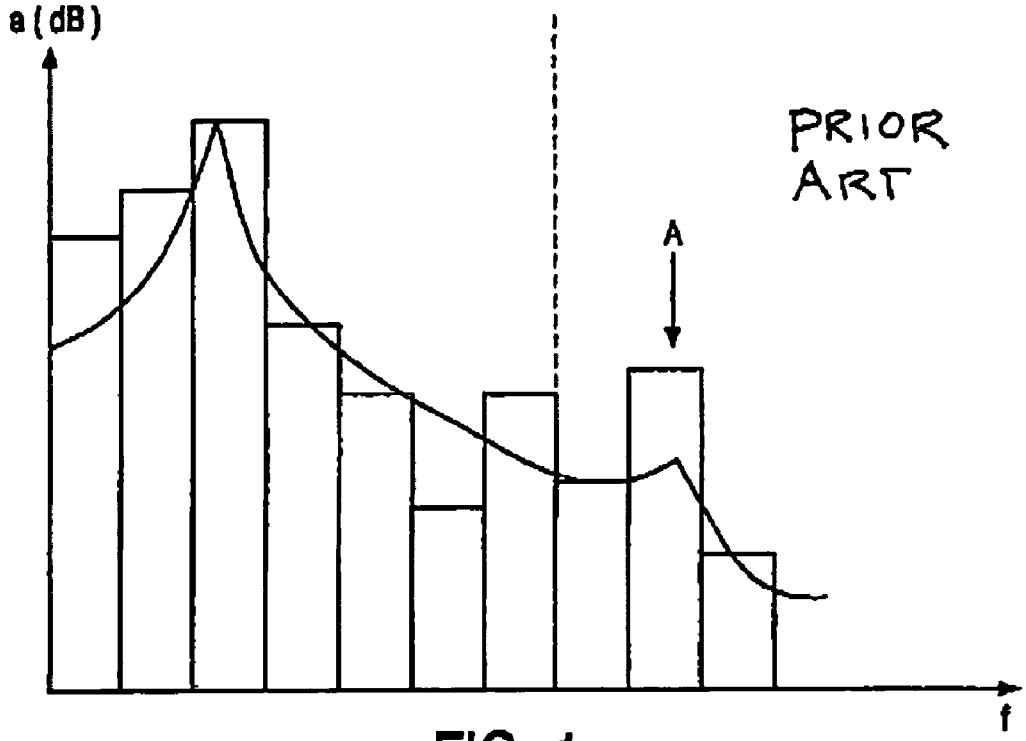
FIG. 1 illustrates a stylised view of the frequency build-up of a typical audio segment and further shows a masking threshold.

Referring to FIG. 1, there is shown a stylised view of the build-up of a typical audio segment, wherein an amplitude a is given as function of a frequency f. Each bar in this Figure represents a frequency band (or frequency bin) of an overall signal. Typically, transform coders for encoding audio signals partition received audio signal according to such frequency bands.

The dashed curved line represents a masking threshold. This masking threshold represents the level of quantization noise which can be introduced into the audio signal without a listener noticing the noise and may be determined by psycho-acoustical modelling.

Any conventional coding scheme will have particular limitations. For instance, a first coding scheme might take the entire signal comprising each frequency band and allocate a variable number of bits to each band so as to completely encode the signal, the frequency band having the highest amplitude signal being allocated the most bits and the lowest amplitude signals being allocated the fewest bits. Another scheme might have an overall fixed-bit budget for encoding and may allocate bits first to those frequency bands which are perceptually most significant according to the psycho-acoustic model.

The former coding scheme has disadvantages in that the bit budget is variable and for signal periods in which there is a significant amount of signal information to convey, bitrate problems may be encountered with the total information to be transmitted for each time frame being susceptible of very wide variation. In this regard, if a bandwidth limitation is imposed on such a scheme, and if the various bits allocatable to the frequency bands is done on a lowest to highest frequency basis, a bandwidth limitation may need to be imposed and this is represented by the dashed vertical line in FIG. 1. Here, because all bands cannot be encoded with enough accuracy for a desired bit rate, the higher frequency signals have been discarded. Therefore, all bands beyond this bandwidth limitation are not encoded at all, despite the fact that at least one of them (marked A in the Figure) is clearly above the masking threshold.

In certain prior schemes, if the choice were made to encode band A of FIG. 1, then the encoding bandwidth would have to be switched momentarily to a higher value. However, this is not acceptable and it would conflict with the bandwidth used in the foregoing frames and give rise to switching artefacts.

In the second of the two mentioned encoding schemes encoding of the more audibly perceptible bands on a priority basis may, in some cases, lead to one or more of the less significant bands (those shown shaded in FIG. 2) having no bits allocated to them. Having no bits allocated to certain frequency bands however means that certain parts of the spectrum do not contain any energy at all and such voids in the frequency spectrum can produce a signal which is perceived by the listener as harsh, and it will also give rise to bandwidth switching artefacts because the highest bands which receive energy may vary from frame to frame.

According to the methods of the present invention, in the proposed encoding scheme bits are allocated on a priority basis to those frequency bands having signals which are most perceptible to the listener (i.e. those which exceed the masking threshold by a given amount). For those frequency bands which have signals with an amplitude nearer the masking threshold and for which in a bit budget based scheme there are insufficient remaining bits to fully encode, the bands in question are allocated one or more noise filling parameters. In the alternative, where a scheme is used in which there is a variable bit budget, a choice may be made to encode fully only those bands which exceed the masking threshold by more than a predetermined amount and for those which do not exceed the threshold by the predetermined amount a noise fill parameter is selectively allocated. This predetermined amount may be allowed to vary on a frame by frame basis if so required to obtain a certain average bit rate, imposed on the encoder.

Figure 2:
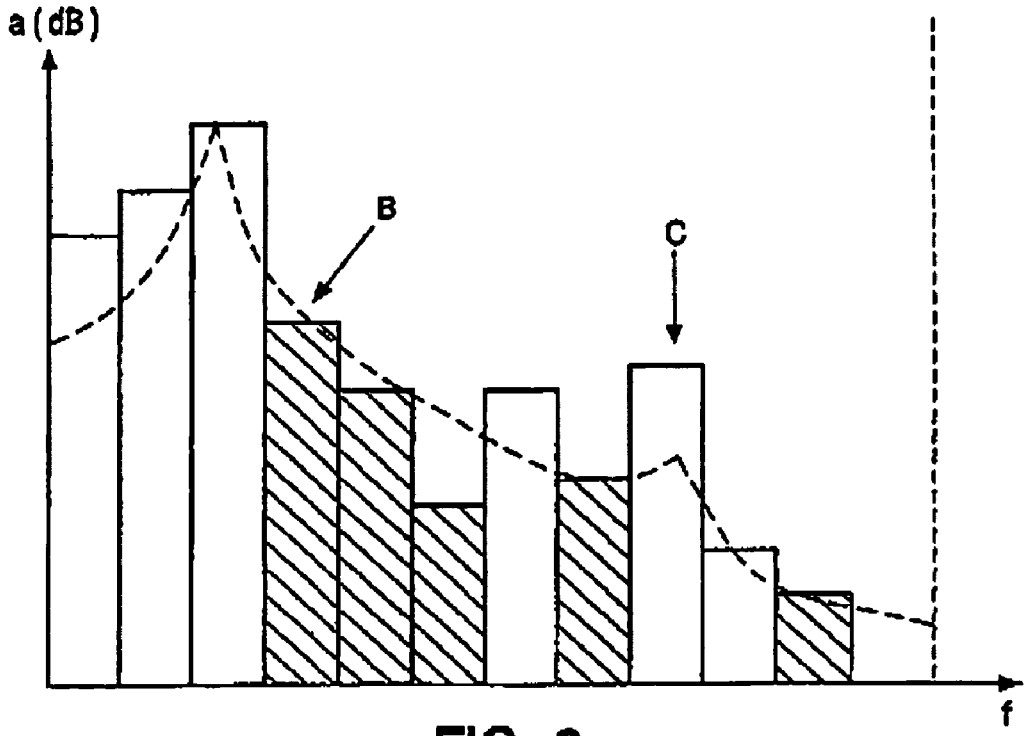
FIG. 2 shows the same signal as FIG. 1, with perceptually less important frequency bands shown shaded.

Consider the frequency band denoted by letter B of FIG. 2. Here it is noted that this frequency band includes a signal which on average is below the masking level. However, the amplitude of that signal is relatively high and comparable with that of the frequency band C of FIG. 2. The distinction between bands B and C however is that in the frequency area of band C the human ear is more sensitive and that therefore that signal is of more significance. In a scheme having a fixed bit budget in order to provide an efficient allocation of bits, useful savings may be made by encoding on a priority basis those bands which exceed their respective threshold levels by a greater extent and, when the remaining allocatable bits run too low to fully encode, remaining less relevant bands, bands such as band B, are represented using a noise filling parameter which indicates to a reproduction stage that noise is to be injected across the frequency band in question, up to a given amplitude.

In variable bit budget schemes, a decision may perhaps be made that for each frequency band which exceeds its masking level by a predetermined amount, full encoding will occur, whereas for others noise fill parameters will be allocated.

It is important to note here that if the signal level is actually below the masking threshold, there is no real utility, but no harm either, in injecting noise simply because it is inaudible anyway. It is specifically for the frequency bins that are just above the masking threshold that it proves worthwhile, for the improvement of quality, to inject noise. However, the teachings of the invention encompass both methods which represent all the non-encoded bands with noise fill parameters and those which leave those non-encoded bands which have perceptually irrelevant signal amplitudes empty.

Given the above discussion, a method of encoding of an audio signal will now be described in more detail with the aid of FIG. 3.

Figure 3:
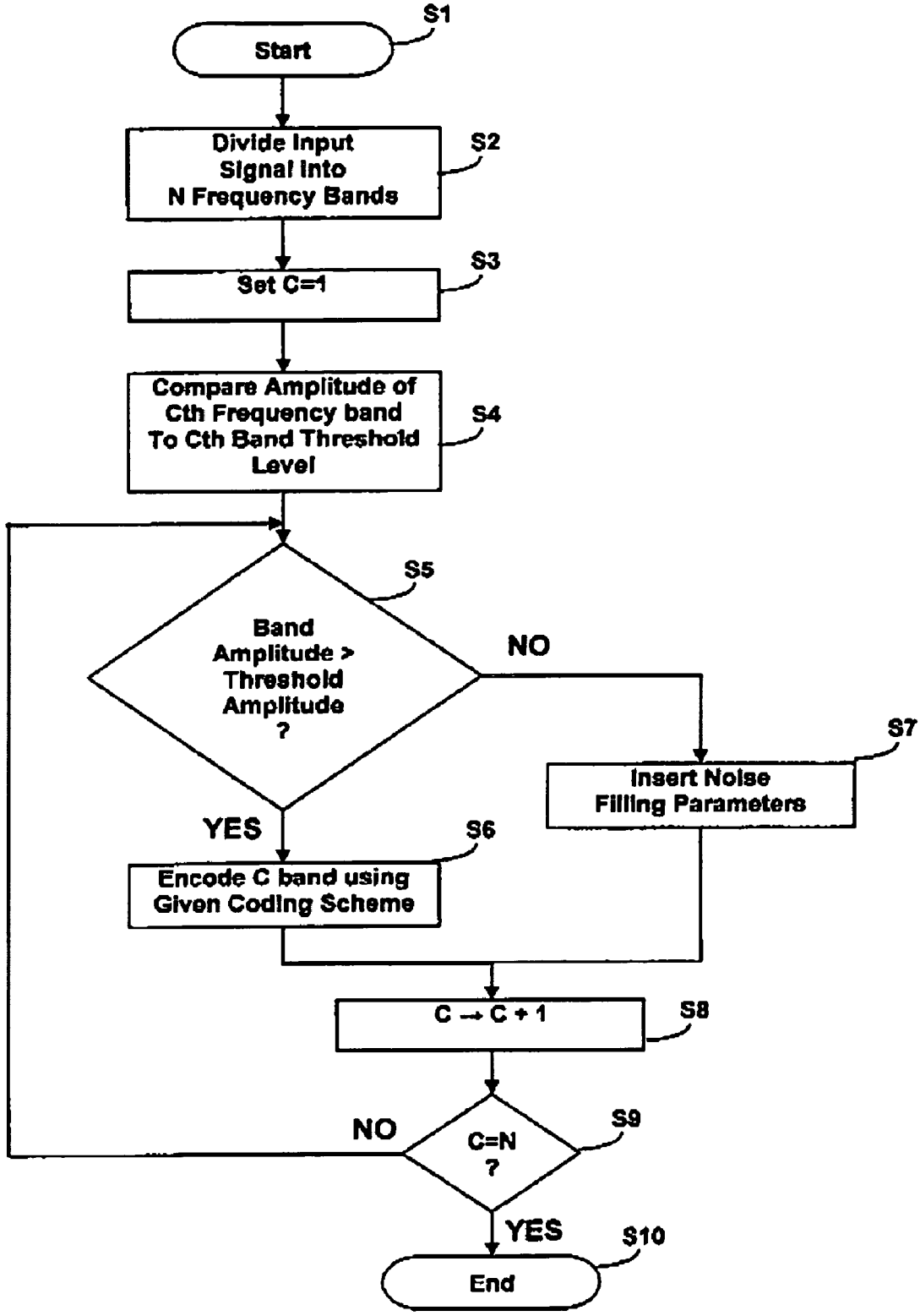
FIG. 3 is a block diagram illustrating an audio encoding method according to an embodiment of the present invention.

In FIG. 3, the following labels apply to the following steps:

| | |
|---|---|
| S1 | = START; |
| S2 | = divide input signal into N frequency bands |
| S3 | = SET C = 1; |
| S4 | = compare amplitude of $C^{th}$ frequency band to a $C^{th}$ band threshold level; |
| S5 | = band amplitude > threshold amplitude?; |
| S6 | = if YES, then encode C band using given coding scheme; |
| S7 | = if NO, insert noise filling parameters; |
| S8 | = C → C + 1; |
| S9 | = "C = N?"; |
| S10 | = END |

Referring to FIG. 3, which for these purposes is assumed to represent a variable bit budget scheme, an encoding module receives an input signal and, in step S2, divides that input signal into N frequency bands. There is then carried out an iterative process in which for each frequency band the amplitude of that frequency band is compared to a respective threshold level. The threshold level for each frequency band will typically be different and correspond to a threshold given by a psycho-acoustical model and may include a certain offset depending on the coding efficiency required.

Following the above comparison step S4, one of two operations is carried out, dependent on whether or not in step S5 the amplitude of the given frequency band is found to be greater than the threshold amplitude. In a first case S6, where the signal amplitude is greater than the threshold amplitude for a particular band, information of that frequency band is encoded using a given coding scheme. On the other hand, step S7, if the band amplitude is not greater than the threshold amplitude then noise filling parameters are inserted into the coded signal.

It will be appreciated that each frequency band has a given frequency range and that the idealised threshold value would vary across the range. For coding purposes, the threshold amplitude set and used for the comparison will in practice be a single average value calculated for the particular band and, for instance, stored in a look-up memory.

Following the respective encoding or insertion operations, a count value is incremented in step S8 and it is checked in step S9 whether or not all frequency bands have been encoded. If the count value indicates that there are more frequency bands to be encoded, then the method progresses such that the amplitude of the signal in the next frequency band is compared to the amplitude of the threshold level for that next frequency band etc. If, on the other hand, all frequency bands have now been encoded then the procedure comes to an end S10 or, more exactly, the procedure for that particular time frame has been completed and an encoding operation may be carried out for a next time frame of information.

In a system in which there is a fixed bit budget per time frame, frequency bands are encoded on a priority basis. In other words, those bands having signal amplitudes which exceed the threshold by the greatest amounts are fully encoded, whereas those which are nearer to the threshold may be selectively allocated noise fill parameters dependent on the number of bits remaining in the bit budget.

It is important to realise when considering the encoding method that the particular encoding scheme for encoding of the given frequency bands could be one of any number of encoding methods and is not limited to any particular compression system. However, the system utilised for encoding may typically be some kind of predictive coder such as adaptive predictive coding (APC) or some form of linear predictive coding (LPC).

There will now be described a possible implementation of the noise filling parameters which can be used for the less significant, or more perceptually irrelevant, frequency band coding.

For a given simple transform encoder, one property of that coder is that bits are first allocated to bands which are perceptually most important. Consequently, as explained previously, such a simple transform encoding process can result in certain frequency bands having no bits allocated to them. To implement noise filling in relation to such a transform encoder, a small number of bits from the total bit rate budget may be used for encoding noise filling parameters for the otherwise empty bands. In reality, only one parameter is required to describe noise in each otherwise empty band. The important parameter in question is the RMS value of the amplitude of the noise signal to be injected in that band.

The empty bands were filled in the spectral domain with random noise drawn from a uniform distribution with an RMS value A.

The RMS value, A, is obtained using equation (1):

$$A = \frac{1}{N}\sqrt{\sum_{n=1}^{N} X_n^2} \tag{1}$$

In equation 1, $X_n$, is the sample value of the $n^{th}$ frequency band (or bin) under consideration. The RMS values were quantized to a one decibel grid and encoded using Huffman coding.

In other words, at the encoder side the original input samples $X_n$ that correspond to the band where noise should be injected, are put into equation 1 and the value A is calculated. This value is converted into dB values and quantized onto a 1 dB grid. This quantized parameter is encoded into the bitstream and decoded by the receiver. Then a random generator generates random samples with a uniform probability density function such that the expected RMS value of those random samples (in dB) corresponds to the decoded value of A. In other words, at the receiver side, random noise is generated at the appropriate level defined by the parameter A.

In the above implementation, it will be noted that using part of the bit stream for transmitting the Huffman coded RMS values goes with the expense of those bits which are available for encoding sample values of remaining bands. However, testing shows that comparing this scenario where bits are robbed in order to fill empty bands, the perceived result is improved with respect to the situation where bands are left empty. However, given that this scheme will mean that, inevitably, certain bands are encoded with less accuracy, it is also within the scope of this invention to implement a system in which the quality of the waveform encoded part is not compromised by providing additional bits for encoding of the noise filling parameters.

The noise parameters are encoded at the place where the point where the signal information is ordinarily found. However, some signalling for the decoder is needed to indicate that a noise parameter instead of signal information will be coming up next in the bitstream. In our approach this may be done via an identifier that encodes the number of quantization levels, e.g. the number of levels that are used for storing each bin of the signal information. When the number of quantization levels is larger than 0, it implies that signal information will follow, when the quantization level is zero it implies that no signal information will follow. In conventional schemes, without noise filling, there would just be an empty band following a 0 number of quantization levels identifier. In this scheme, a zero number of quantization levels indicates that a noise fill parameter (which itself may be zero for perceptually insignificant signal amplitudes) will follow.

Figure 4:
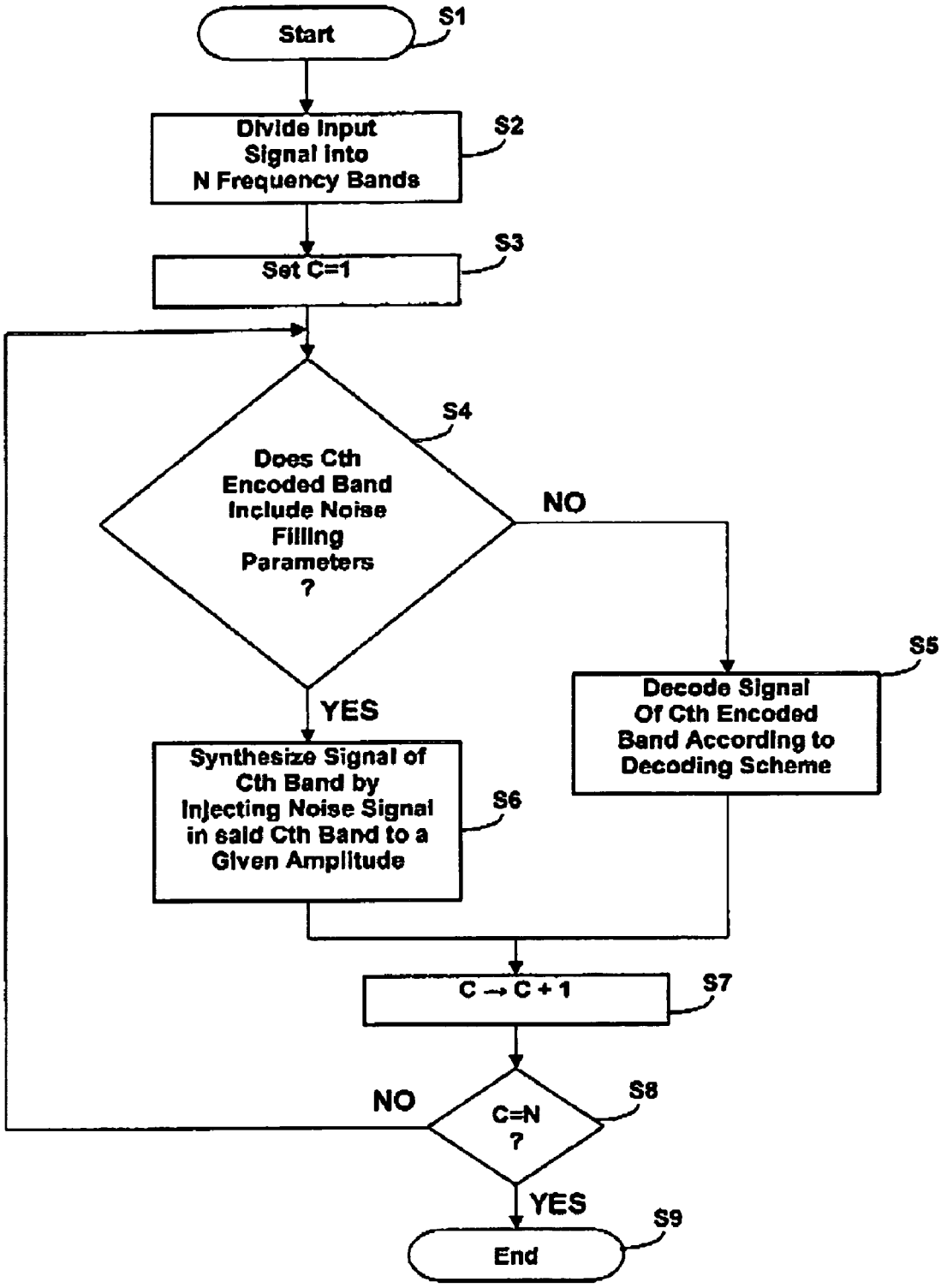
FIG. 4 is a block diagram illustrating an audio decoding method according to an embodiment of the invention.

Referring now to FIG. 4, there is described a method by which a decoding module may decode a signal which has been encoded according to the FIG. 3 method.

Referring to FIG. 4, the labels S1 to S9 refer to the following terms:

S1 = START;
S2 = receive encoded signal of N frequency bands;
S3 = set C = 1;
S4 = does $C^{th}$ encoded band include noise filling parameters?
S5 = if no, decode signal of $C^{th}$ encoded band according to decoding scheme;
S6 = if yes, synthesize signal of $C^{th}$ band by injecting noise signal in said $C^{th}$ band to a given amplitude;
S7 = C becomes C + 1;
S8 = C = N?;
S9 = END In a step S2 of FIG. 4, the encoded signal of N frequency bands is received. A count value is set in S3 to an initial value of 1 and, for the first band of the N frequency bands it is then determined in S4 whether or not that band includes a noise filling parameter.

If the first encoded frequency band includes a noise filling parameter then in S6 that parameter is decoded and an output signal relating to that first band is synthesised by providing a noise signal to an amplitude given by the noise fill parameter.

If, on the other hand, the signal of the first encoded band does not include a noise filling parameter then in S5 the encoded signal is decoded according to its particular decoding scheme.

In a step S7, the count value is incremented and the next encoded band is decoded. Once the count value indicates in S8 that all encoded frequency bands of the particular time frame in question have been decoded, then the decoding sub-routine ends in S9. More precisely, when all signals of a particular time frame have been decoded, then the decoding method commences work on decoding the frequency bands of the received coded signal for the next time frame.

From the above description, it will be appreciated that there is provided a method of efficiently encoding audio signals and decoding audio signals in which perceptually less relevant material is not fully encoded but, instead, is represented by one or more noise filling parameters. Such noise filing parameters are decoded at a decoding end of the algorithm in order to synthesise the perceptually irrelevant signal portions by means of providing a noise signal at a given amplitude.

Figure 5:
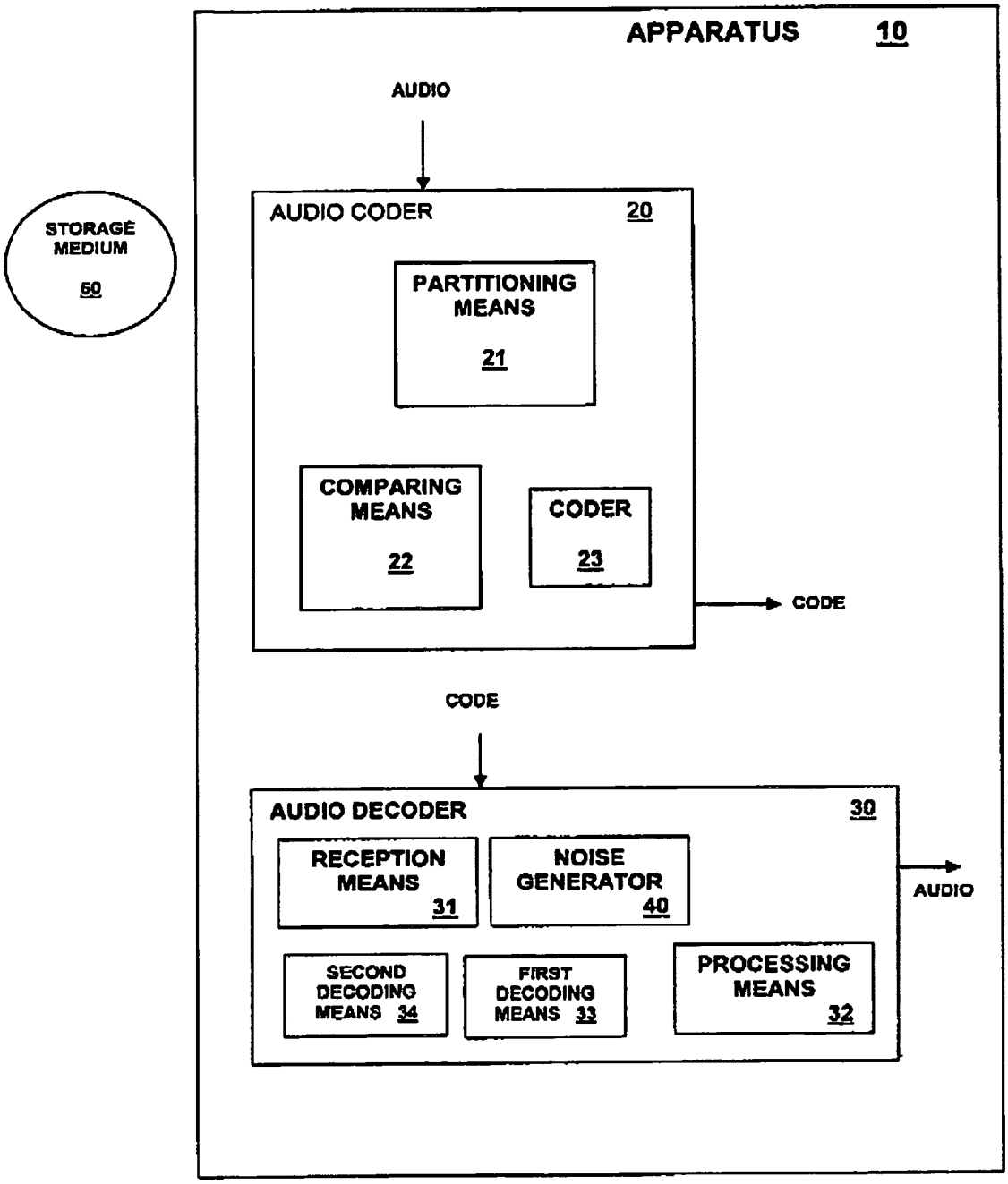
FIG. 5 is a schematic block diagram of apparatus including an audio coder and decoder.

Referring to FIG. 5, there is shown in schematic format an apparatus 10, including an audio coder 20 and an audio decoder 30.

The audio coder 20 works in accordance with the audio coding method previously described herein, so as to code an incoming audio stream in accordance with a given coding format and utilising the method of the present invention to provide noise fill parameters to selectively replace those perceptually less relevant signal bands.

The audio coder 20 includes partitioning means 21, comparing means 22 and a coder 23.

The partitioning means 21 partitions a signal into a plurality of frequency bands. The comparing means 22 compares amplitudes of the signal in the various frequency divided bands to respective threshold values. The coding means 23 codes the signal of the divided frequency bands on a priority basis such that frequency bands in which the amplitude of the signal in a particular frequency band exceeds its respective threshold by a greatest amount are coded according to a given coding scheme, other frequency bands being selectively allocated a noise fill parameter.

The audio decoder 30 functions so as to receive coded data at an input thereof and to provide decoded data at its output. The decoder 30 includes a noise generator 40 which may be used so as to fill the indicated bands to the given signal amplitude level with frequency band limited noise as desired.

The audio decoder 30 further comprises reception means 31, processing means 32, first decoding means 33 and second decoding means 34.

The reception means 31 receives a coded audio signal. The processing means 32 determines for each given frequency band of the coded signal, whether that band includes encoded signal information relating to the amplitude of a transmitted signal within the given frequency band or whether it includes a noise fill parameter. If the processing means 32 determines that the received signal includes encoded signal information then the first decoding means 33 is arranged to decode such information to produce an output audio signal portion for respective frequency bands. If, on the other hand, the processing means 32 determines that the given frequency band includes a noise fill parameter then the second decoding means 34 synthesizes an output signal portion for that frequency band by outputting with the aid of noise generator 40 a noise signal across the frequency range of that frequency band to an amplitude indicated by the noise fill parameter as previously discussed.

FIG. 5 also shows a storage medium 50, on which a signal encoded in accordance with the audio coder is stored and from which the audio decoder 30 may reconstruct an audio signal.

As will be evident from the above, embodiments of the invention aim to overcome the annoying effects of bandwidth switching without having to limit the encoding bandwidth to a safe, conservative value that guarantees that every frequency can be encoded with at least some level of accuracy given the number of available bits. In other words, embodiments of this invention permit an effective increase in audio bandwidth without introducing the annoying bandwidth switching artefacts that one would otherwise encounter using a very limited bit budget.

It will be evident to the man skilled in the art, that where hardware elements are mentioned, these may, where appropriate, be replaced by software elements. Conversely, where software elements are mentioned, where appropriate these may be replaced by hardware equivalents.

As will be well understood, the method of the present invention may be used with many different types of generalised audio encoding schemes and is extremely bit efficient.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word 'comprising' does not exclude the presence of other elements or steps than those listed in a claim. The invention can be implemented by means of hardware comprising several distinct elements, and by means of a suitably programmed computer. In a device claim enumerating several means, several of these means can be embodied by one and the same item of hardware. The mere fact that certain measures are recited in mutually different dependent claims does not indicate that a combination of these measures cannot be used to advantage.

The invention claimed is:

1. A method of coding an audio information signal, the method comprising:

partitioning the information signal into a plurality of divided frequency bands;

comparing an amplitude of the information signal in each of the plurality of frequency divided bands to a respective threshold value; and coding the information signal of the divided frequency bands on a priority basis such that frequency bands in which the amplitude of the information signal in a particular frequency band exceeds its respective threshold value by the greatest amount are coded according to a given coding scheme, whereas for other frequency bands a noise fill parameter is selectively allocated.

2. The method of claim 1, wherein the threshold value for a given frequency band is the amplitude above which noise is perceptible and below which it is imperceptible to the human ear for the band in question according to a psycho- acoustical model.

3. The method of claim 1, wherein for those frequency bands in which the information signal amplitude is less than the respective threshold, neither encoding nor allocation of a noise filling parameter is carried out.

4. The method of claim 1, wherein for each of those frequency bands in which the information signal is not fully encoded, a noise fill parameter is allocated.

5. The method of claim 1, wherein the given coding scheme has a fixed bit budget and wherein bits are allocated on the priority basis for coding those information signals in frequency bands for which the information signal amplitude exceeds the respective threshold by the greatest amount and wherein, if the remaining bit budget drops below a minimum amount, information signals of remaining uncoded frequency bands are allocated noise fill parameters.

6. The method of claim 1, wherein the noise fill parameter comprises a representation of the magnitude of the noise to be inserted in the respective frequency band.

7. The method of claim 1, wherein the noise fill parameter comprises an encoded RMS value representing the average amplitude of the received audio information signal across the respective frequency band.

8. The method of claim 1, wherein for frequency bands to which a noise fill parameter is allocated, the noise fill parameter is encoded and provided in a position in an output signal where encoded information signal would otherwise be present.

9. The method of claim 8, wherein an identifier is provided associated with each band to indicate whether a noise fill parameter or encoded information signal is present.

10. The method of claim 9, wherein the identifier is a parameter ordinarily used to indicate a number of quantization levels in encoded information signal.

11. The method of claim 10, wherein if the identifier indicates a zero number of quantization levels, then this is interpreted as meaning that a noise fill parameter, rather than encoded information signal is included for the respective band.

12. A method of coding an audio information signal, the method comprising:

partitioning the information signal into a plurality of divided freciuency bands:

comparing an amplitude of the information signal in each of the plurality of frequency divided bands to a respective threshold value: and coding the information signal of the divided frequency bands on a priority basis such that frequency bands in which information signal amplitude in a particular frequency band exceeds the respective threshold value by more than a predetermined value are coded according to a given coding scheme, whereas those frequency bands, in which the information signal amplitude does not exceed the respective threshold by the predetermined value, are selectively allocated a noise fill parameter.

13. A method of decoding a signal, where the signal has been encoded according to the method of any of claims 1 to 12, the decoding method comprising:

receiving a coded audio signal;

for a given frequency band of the coded signal determining whether a received signal includes encoded signal information relating to the amplitude of a transmitted signal within the given frequency band or whether it includes a noise fill parameter;

if the received signal includes encoded signal information, decoding the information to produce an output audio signal portion for that frequency band; and if the received signal includes a noise fill parameter, synthesizing an output audio signal portion for that frequency band by outputting a noise signal across the frequency range of that frequency band to an amplitude indicated by the noise fill parameter.

14. Audio coding apparatus arranged for coding an input signal and including: partitioning means for partitioning the signal into a plurality of frequency bands; comparing means for comparing amplitudes of the signal in the various frequency divided bands to respective threshold values; and a coder for coding the information signal of the divided frequency bands on a priority basis such that frequency bands in which the amplitude of the signal in a particular frequency band exceeds its respective threshold value by the greatest amount are coded according to a given coding scheme, whereas for other frequency bands a noise fill parameter is selectively allocated.

15. The apparatus as defined in claim 14 further comprising audio decoding apparatus for decoding an encoded audio signal, the decoding apparatus comprising:

reception means for receiving a coded audio signal;

processing means arranged to, for a given frequency band of the coded signal, determine whether a received signal includes encoded information signal relating to a relative amplitude of a transmitted signal comparing to its respective threshold value within the given frequency band or whether it includes a noise fill parameter;

first decoding means for, if the received signal includes encoded information signal, information, decoding the encoded information signal to produce an output audio signal portion for that frequency band; and second decoding means for, if the received signal includes a noise fill parameter, synthesizing an output audio signal portion for that frequency band by outputting a noise signal across the frequency range of that frequency band to an amplitude indicated by the noise fill parameter.

16. Audio apparatus comprising an audio coder according to claim 14 and/or an audio decoder.

* * * * *